US009714527B2

(12) United States Patent
Winkler

(10) Patent No.: US 9,714,527 B2
(45) Date of Patent: Jul. 25, 2017

(54) LOCKING DEVICE

(71) Applicant: NOVOMATIC AG, Gumpoldskirchen (AT)

(72) Inventor: Heinz Winkler, Gumpoldskirchen (AT)

(73) Assignee: NOVOMATIC AG, Gumpoldskirchen (AT)

( * ) Notice: Subject to any disclaimer, the term of this patent is extended or adjusted under 35 U.S.C. 154(b) by 267 days.

(21) Appl. No.: 14/406,512

(22) PCT Filed: May 28, 2013

(86) PCT No.: PCT/EP2013/001568
§ 371 (c)(1),
(2) Date: Dec. 8, 2014

(87) PCT Pub. No.: WO2013/182278
PCT Pub. Date: Dec. 12, 2013

(65) Prior Publication Data

US 2015/0167353 A1 Jun. 18, 2015

(30) Foreign Application Priority Data

Jun. 6, 2012 (DE) ..... 10 2012 011 332

(51) Int. Cl.
*E05C 3/16* (2006.01)
*E05B 63/00* (2006.01)
*E05C 3/04* (2006.01)

(52) U.S. Cl.
CPC ..... *E05B 63/00* (2013.01); *E05B 63/006* (2013.01); *E05B 63/0034* (2013.01);
(Continued)

(58) Field of Classification Search
USPC ..... 292/215, 304
See application file for complete search history.

(56) References Cited

U.S. PATENT DOCUMENTS 3,465,557 A * 9/1969 Ryder ..... B05B 3/10 292/95
3,593,458 A 7/1971 Wahlfeld et al.
(Continued)

FOREIGN PATENT DOCUMENTS

BE 806882 5/1974
CA 2691923 8/2011
(Continued)

*Primary Examiner* — Mark Williams
(74) *Attorney, Agent, or Firm* — Levine Bagade Han LLP

(57) ABSTRACT

The present invention relates to a locking apparatus for introduction into a recess of a device to be locked, wherein the locking apparatus has an actuating pin and a bolt part which is rotationally fixedly connectable to the actuating pin and which can be locked and/or unlocked by rotating the actuating pin, wherein the bolt part can be fastened to the named actuating pin in different positions. The invention further relates to the use of such a locking apparatus as a transport lock of a carcass part to be locked such as a device housing door of a security-sensitive gambling device, betting device and/or entertainment device. In accordance with the invention, the actuating pin and the bolt part have releasable latching means having a plurality of latching positions for latching the bolt part to the actuating pin in a plurality of axial positions. The latching means in this respect comprise latch contours which engage into one another in a shape-matched manner, which can be pushed beyond one another in the longitudinal direction of the actuating pin with elastic deformation and which can latch into one another transversely to the longitudinal direction of the actuating pin by elastic recoil so that the bolt part is held axially at the actuating pin in the respective latching position.

20 Claims, 3 Drawing Sheets

Figure 1:
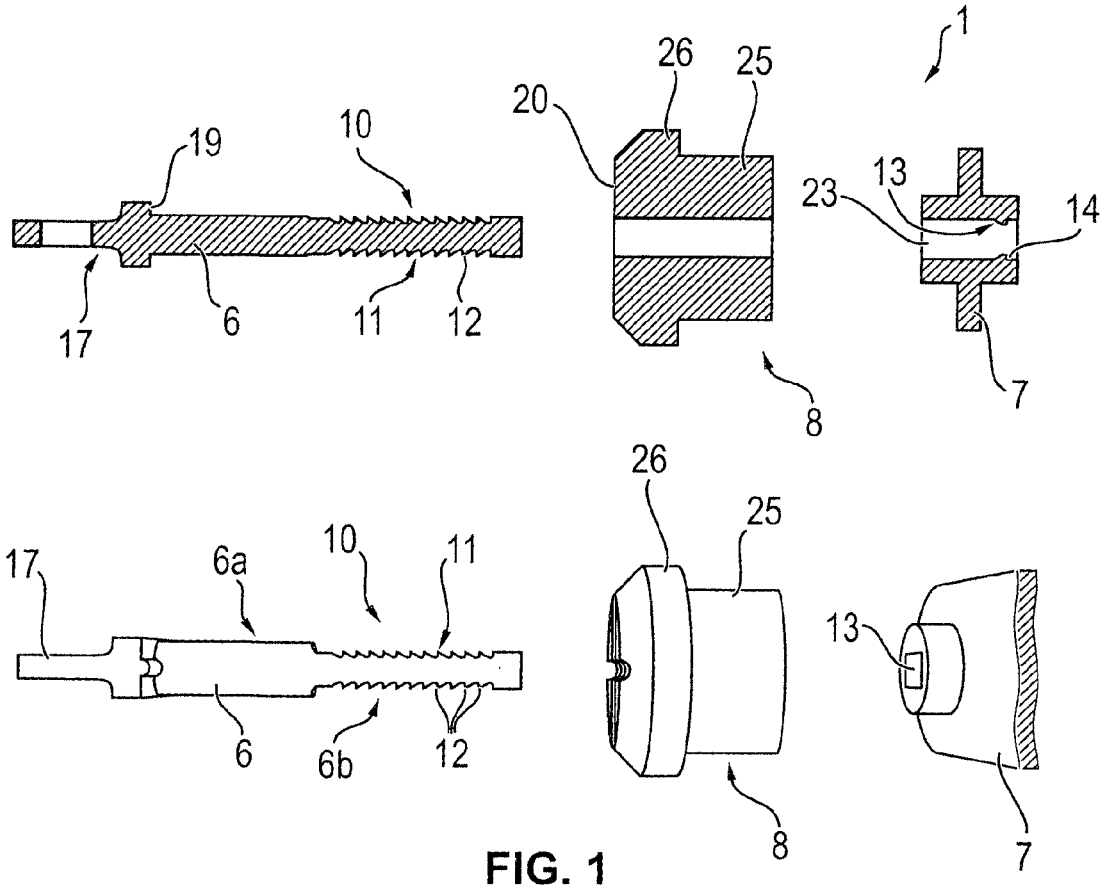

(52) U.S. Cl.
CPC ..... *E05B 63/0056* (2013.01); *E05C 3/042* (2013.01); *Y10T 70/7486* (2015.04)

(56) References Cited

U.S. PATENT DOCUMENTS

| | | | | |
|---|---|---|---|---|
| 4,492,394 | A | 1/1985 | Dignan | |
| 4,718,195 | A | 1/1988 | Ortega | |
| 4,910,982 | A * | 3/1990 | Dana | E05B 9/08 70/370 |
| 8,517,435 | B2 * | 8/2013 | Runge | E05C 3/042 292/194 |
| 2005/0192101 | A1 | 9/2005 | Businger et al. | |
| 2006/0012184 | A1 | 1/2006 | Ottesen et al. | |
| 2010/0117384 | A1 | 5/2010 | Cole et al. | |

FOREIGN PATENT DOCUMENTS

| | | |
|---|---|---|
| CH | 553 903 | 7/1974 |
| DE | 3932939 | 4/1991 |
| DE | 9401456 | 3/1994 |
| DE | 29707314 | 6/1997 |
| WO | WO 2008/119541 | 10/2008 |

* cited by examiner

LOCKING DEVICE

The present invention relates to a locking apparatus for introduction into a recess of a device to be locked, wherein the locking apparatus has an actuating pin and a bolt part which is rotationally fixedly connectable to the actuating pin and which can be locked and/or unlocked by rotating the actuating pin, wherein the bolt part can be fastened to the actuating pin in a plurality of positions. The invention further relates to the use of such a locking apparatus as a transport lock of a carcass part to be locked such as a device housing door of a security-sensitive gambling device, betting device and/or entertainment device.

End customers or device operators of various security-sensitive equipment such as gambling machines, machines or entertainment machines want to be able to lock the security-relevant housing components with their own locks to be able to ensure the observation of their own, individual security requirements or to be able to exclude security vulnerabilities, for example during transport. With respect to the named gambling machines, betting machines and/or entertainment machines, this may be the device door which is to be locked by a user-specific lock. Depending on the device, however, this can also be a cover or a flap, for example, with which a money storing unit in the device interior can be closed or a removable drawer or a tray on which a security-relevant component is provided.

Such devices to be locked should nevertheless to date already be provided with locking apparatus by the manufacturer, for example to prevent an unwanted opening or an unauthorized opening during transport or to be able to carry out a function test during acceptance, which can to date require a proper locking of doors and flaps. In order, on the one hand, to ensure a proper locking, but, on the other hand, to facilitate the conversion of the locking apparatus frequently carried out by the end customer, it would be desirable to be able to introduce a fully functional locking apparatus into the recess of the device to be locked into which the lock desired by the end customer is installed according to its intended purpose and simultaneously to allow an authorized user a simple dismantling. In this respect, it would furthermore be desirable to be able to use the locking, apparatus for different recesses or devices to be locked since the named recesses are sometimes ordered by different customers in different geometries in order exactly to match the customer's individual, final locking apparatus. As, for example, the documents US 2005/0192101, US 2006/0012184 or US 2010/0117384 show, door lock's of gaming machines can have very different configurations so that the door recesses or housing recesses into which these locks have to be inserted with an exact fit can be configured very differently.

Documents CA 2691923 U.S. Pat. No. 3,593,458 or U.S. Pat. No. 4,718,195 show transport locking apparatus by means of which doors can be locked for transport to the final customer, wherein the corresponding locking apparatus can be inserted into the door or into the door post recess in which then the final door lock is installed. These transport locking apparatus are, however, rather of only a provisional nature and not really fully functional in the sense that the door could be locked and unlocked multiple times by an actuating element to be handled conventionally such as a rotary knob or a slider. In addition, these transport locking apparatus require an individual matching to the device to be locked or they can practically not be used for different doors or inserted into differently configured recesses.

Document WO 2008/119541 shows a locking apparatus for a door in which an actuating pin in the form of a rotatable mandrel can be inserted into a bearing recess of a fitting component, wherein an actuating, handle is plugged onto the mandrel from one side and the mandrel itself is rotationally fixedly plugged into a transmission plate which converts a rotary movement of the mandrel into a sliding movement of the actual bolt part of the fitting.

Documents DE 39 32 939 and CH 553 903 show further locking apparatus in which the locking plate is respectively screwed tight to the actuating pin. Furthermore, document U.S. Pat. No. 4,492,394 shows a locking apparatus in which the locking plate can be fastened to the actuating pin in different axial positions. The locking plate is in this respect likewise screwed onto the actuating pin and is secured against rotation at a specific screwing height by a friction clutch, at least as long as the rotary actuating forces do not exceed the inhibition of the friction clutch. If the actuating pin is overrotated while the latch plate is in contact, the named friction clutch slips so that the locking plate is screwed to the pin and is thus axially adjusted.

It is the underlying object of the present invention to provide an improved locking apparatus of the initially named kind which avoids disadvantages of the prior art and further develops the latter in an advantageous manner. The locking apparatus should preferably be able to be inserted into different recesses with an exact fit and should ensure a fully functional lock also with multiple actuation, but simultaneously allow a simple dismantling, as free of tools as possible, to simplify the replacement of the locking apparatus by an authorized end customer.

This object is satisfied in accordance with the invention by a locking apparatus in accordance with claim 1 and by the use of such a locking apparatus in accordance with claim 17. Preferred embodiments of the invention are the subject of the dependent claims.

To be able to match the locking apparatus simply to recesses of different depths or to devices to be locked of different thickness, the bolt part can be fixed at different sections of the actuating pin so that the locking apparatus receives a different length. In accordance with the invention, actuating pin and the bolt pan have releasable latching means having a plurality of latching positions for latching the bolt part to the actuating pin in a plurality of axial positions. The latching means in this respect comprise latch contours which engage into one another in a shape-matched manner, which can be pushed beyond one another in the longitudinal direction of the actuating pin with elastic deformation and which can latch into one another transversely to the longitudinal direction of the actuating pin by elastic recoil so that the bolt part is held axially at the actuating pin in the respective latching position. Depending on how thick the carcass is in which the recess is formed into which the locking apparatus is to be introduced or depending on how large the spacing is of the counter-piece to be caught by the latch part from the named recess, the bolt part can be fixed to the actuating pin in a different axial position. The locking apparatus can hereby be used simply for different devices to be locked, wherein the bolt part fixes itself at the actuating pin on the plugging together in the respectively desired position by the latching means. The bolt part and the actuating pin only need to be plugged to one another in the axial direction of the actuating pin and to be displaced relative to one another for so long until the desired position is found in which the latching means then lock.

The latching means can in this respect operate elastically to be able to be locked and unlocked a multiple of times and to ensure a multiple reuse of the locking apparatus at different devices to be locked. In this respect, the latching means are configured as releasable in a nondestructive manner so that the locking apparatus can be dismantled in a simple manner, preferably free of tools, in that the bolt part is again released from the actuating pin. The dismantling by an authorized end customer is hereby considerably simplified.

The latching means can in this respect generally comprise differently configured latch contours. In an advantageous further development of the invention, the latch contours of the latching means comprise at least one latch projection which is configured as elevated transversely to the longitudinal direction of the actuating pin and at least one latch depression which is configured as sunk transversely to the longitudinal direction of the actuating pin, wherein the latch depression and the latch projection are shape-matched to one another, are in particular configured complementary to one another, so that the latch projection can be lowered into the latch depression and can latch into it. To be able to realize the named plurality of latching positions and to be able to fix the bolt part at the actuating pin in different axial positions, the latch contours in this respect advantageously comprise a plurality of latch depressions which are arranged behind one another and/or spaced apart from one another in the longitudinal direction of the actuating pin so that the at least one latch depression can selectively latch into one of the plurality of latch depressions. Alternatively or additionally, a plurality of such latch projections can conversely also be provided of which selectively one can latch into the at least one latch depression, wherein the named plurality of latch projections can be arranged behind one another and/or spaced apart from one another in the longitudinal direction of the actuating pin.

The latch contours, in particular in the form of the named latch projections and latch depressions, can be formed as undercuts, viewed in the longitudinal direction of the actuating pin, wherein the undercuts at the bolt part and at the actuating pin are shaped-matched to one another so that a respective undercut pair disposed in engagement engages under one another transversely to the longitudinal direction of the actuating pin. A covering of the respective latch contour pair arises due to the undercut of the latch contours—viewed in the longitudinal direction of the actuating pin—in the latched position.

At least one of the named latch contours, for example the latch projection or the latch depression or also both, are in this respect themselves elastic or are arranged on an elastic part or on a movably supported, elastically preloaded part so that at least one of the latchable latch contours is movable so far transversely to the longitudinal direction of the actuating pin for unlatching that the latch contour can be pushed beyond the other latch contour.

In an advantageous further development of the invention, the latching means can comprise a ribbed and/or grooved surface structure at the actuating pin and/or at the bolt part, which surface structure can be brought into shape-matched holding engagement with a counter-contour piece with elastic and/or plastic deformation of the surface structure and/or of the named counter-contour piece on the axial plugging onto one another of the bolt part and actuating pin. Such a ribbed or grooved surface structure allows a fine setting of the desired axial position of the bolt part and the actuating pin. The ribbed surface structure at the actuating pin can advantageously comprise a plurality of holding ribs at the actuating pin which are preferably arranged, staggered behind one another in the longitudinal direction of the actuating pin, at least partly at the periphery of the actuating pin, wherein the counter-contour piece can comprise at least one holding rib at the bolt part which can advantageously be provided at least partly at an inner peripheral side of the bolt part, in particular in a passage recess pluggable onto the actuating pin. The arrangement of the holding ribs staggered behind one another at the actuating pin allows a large adjustment path. At the same time, on the provision of the counter-contour piece in a passage recess, a sufficiently rigid seat can be ensured to apply the holding forces.

In an advantageous further development of the invention, the ribbed or grooved surface structure or the counter-contour piece cooperating therewith can be configured such that different actuating forces and holding forces result, in particular such that the force required for plugging on the bolt part and the actuating pin is smaller than the force which is required for the opposite, axial release of the latch connection. A high operating comfort in the assembly can be combined with sufficiently high holding forces by such a configuration of the grooving or ribbing. The relatively small plug-on forces allow a simple plugging on by hand and thus also a precise, coordinated achieving of the desired position, whereas conversely the higher unlatching forces ensure that the bolt part is sufficiently held at the actuating pin and is secured against slipping down. The holding ribs provided staggered behind one another at the actuating pin and/or the holding rib provided at the counter-contour piece can in particular be formed in the manner of saw teeth, i.e. can have flanks of differently strong inclinations, which lock with the respective counter-contour or enter into engagement therewith such that the plugging onto one another with elastic and/or plastic deformation of the involved components is easier than the pulling or pushing apart from one another taking place in the reverse direction.

The locking apparatus can generally be received or supported in the recess of the component to be locked in different manners. For example, the actuating pin can be directly stored or supported in the recess, in particular when the named recess has a rotationally symmetrical contour, which is not, however, a requirement. For example, the actuating pin can comprise a corresponding shoulder which forms an axial support surface and/or a bearing head, for example thickened and in particular cylindrical, which is supported at the peripheral side at an inner contour of the recess or which forms a radial bearing surface. In order, however, to allow a simpler matching to different recesses and to achieve a better rotatability, in an alternative further development of the invention, a rotary guide part can be associated with the actuating pin; it is pluggable with an exact fit into the named recess and has latching means for latching to a marginal contour surrounding the recess.

The actuating pin can advantageously be rotatably received in the rotary guide part, wherein in this case, the rotary guide part can be configured such that the rotary guide part can be rotatably fixedly latched in the recess. In general, the named rotary guide part could, however, also be rotationally fixedly joined to the actuating pin and can in this case be rotatably supported in the recess or in in an interposed bearing piece and/or adapter piece. With a rotatable connection between the actuating pin and the rotary guide part, the fixing of the rotary guide part in the recess is, however, simplified.

In an advantageous further development of the invention, the latching means of the rotary guide pan can comprise at least one latch projection which projects radially at the peripheral side from the carcass of the rotary guide part, which is radially elastically deformable on the axial insertion of the rotary guide part into the recess and which snaps back radially after passing through the recess so that the latch projection prevents a pulling back again or a pulling of the rotary guide part out of the recess. The rotary guide part can in this respect advantageously be configured and/or intended to be plugged into the named recess from an outer side of the component to be latched or of the associated carcass part so that the latch projection comes to lie on an inner wall side or springs back in the locked state so that an unauthorized release of the latch projection is prevented or the latch projection is only accessible and can be opened in an open position of the device to be locked.

In order to be able to insert the rotary guide part with an exact fit into recesses of different depths or to be able to use it for carcass parts of different thicknesses, the latching means of the rotary guide part can comprise a plurality of latch projections which are arranged staggered behind one another in the longitudinal direction of the rotary guide part such that a respective different latch projection can be latched with an exact fit with marginal contours of the recess of different thicknesses. The latch connection in this respect is actuated automatically irrespective of the respective marginal contour thickness such that, on the insertion of the rotary guide part, a plurality of the latch projections arranged staggered behind one another are initially pressed hack and spring back again until the end position of one or more latch projections has been reached, while one or more latch projections remain pressed back since the do not again exit the recess or its narrow section. The rotary guide part is then held with an exact fit in the recess by at least one of the springing-back latch projections moving into the locking position. The locking apparatus can be adapted in a simple manner to carcass parts of different thicknesses or to recesses of different depths and can be used without problem for such differently configured components by the provision of a plurality of latch projections staggered behind one another in the insertion direction of the rotary guide part.

The actuating pin can be received freely rotatable in the rotary guide part or can be rotatable without fixing over the total, optionally limited, rotary range. However, to signal to an operator when the unlocked position or the locked position has been reached, in a further development of the invention, latching means for latching the actuating pin in an unlocked rotary position and/or in a locked rotary position can be provided at the rotary guide part and/or at the actuating pin, wherein the named latching means advantageously snap elastically in the respective latched position and allow a rotation of the actuating pin which is as resistance-free as possible in the unlatched position. In an advantageous further development of the invention, the named latching means can have at least one transverse rib and/or at least one transverse groove at an axial support surface of the rotary guide part and/or of the actuating pin and/or can comprise at least one longitudinal rib and/or at least one longitudinal groove at a radial support surface of the rotary guide part and/or of the actuating pin. In an advantageous further development of the invention, at least one transverse rib extending transversely to the axis of rotation and a transverse groove equally extending transversely can respectively be provided at the end face at the rotary guide part and at the end face at the actuating pin, the transverse rib and the transverse groove latching into one another when they are aligned with one another so that the rotary position of the actuating pin is fixed relative to the rotary guide part. The actuating pin and the rotary guide part can in this respect, for example, be preloaded elastically axially with respect to one another by a spring device or also by a certain elasticity of the actuating pin in the longitudinal direction so that, on a corresponding rotary position, the transverse rib is pulled into the named transverse groove and conversely an unlatching is possible by rotating the actuating pin. The actuating pin can also be axially latched at the rotary guide part, wherein the latching, means can be configured such that the actuating pin has a certain elasticity axially from the latched position, i.e. can be pulled out a little from the latched position and is pulled back again by the latching means.

The axial means for the axial latching of the actuating pin at the rotary guide part can, for example, have a peripheral groove and a peripheral projection cooperating therewith, the two being able to have slanted or rounded flanks to achieve the named elasticity or spring effect.

To be able to secure a plurality of positions by latching, for example the unlocked and the locked position of the bolt part, a plurality of transverse grooves can advantageously be provided for one transverse rib and/or a symmetrical arrangement of transverse grooves and transverse ribs can be provided which can be brought in alignment with one another in different rotary positions.

The actuating pin can advantageously comprise a circular-cylindrical guide section, optionally also a plurality of circular-cylindrical guide sections having relief grooves arranged therebetween, which at least one guide section rotatably supports the actuating pin in a recess, in particular in a recess in the named rotary guide part, such that a smooth rotary actuation of the actuating pin is made possible. On the other hand, the actuating pin can have a latch section which can have a cross-sectional contour differing from the circular and which serves the latch connection with the bolt part at a pin section arranged displaced with respect to the named circular-cylindrical guide section in the axial direction. The cross-sectional contour of the named latch section is in this respect advantageously dimensioned and configured such that it lies within the contour of the circular-cylindrical guide section when observed in the longitudinal direction of the pin so that the latch section can be plugged through the bearing recess without being, caught for a rotatable support of the actuating pin. The named latch section of the actuating pin can in particular have a flattened portion at the peripheral side, preferably two flattened portions arranged opposite one another, at which flattened portions the aforesaid latching means can be provided for latching the bolt part and the actuating pin.

To achieve a simple assembly with a simultaneous protection from unauthorized dismantling, provision is made in an advantageous further development of the invention that the actuating pin has an actuating head and can be plugged into the recess of the device to be locked from a side such that the actuating head comes to lie on a side of the recess and the bolt part can be placed onto the actuating pin from an oppositely disposed side of the recess. The carcass part of the device to be locked having the recess is hereby received in the manner of a sandwich between the actuating head of the actuating pin, on the one hand, and the bolt part to be rotated, on the other hand, so that the bolt part is not accessible in the closed state of the carcass part. Apart from this, the named sandwich-like reception of the carcass part to be locked between the actuating head and the bolt part can also be utilized so that the locking apparatus is secured against unwanted slipping out or pulling out at the carcass part, for example when the latch connection of the aforesaid rotary guide part at the marginal contour of the recess fails. For this purpose, the bolt part can be configured as larger than the recess viewed in the direction of rotation of the locking apparatus and/or can be arranged projecting beyond the recess at the marginal side so that the bolt part seated on the actuating pin prevents a pulling out of the locking, apparatus. In a further development of the invention, the named bolt part can be a bolt part which projects radially from the actuating pin, which is approximately of plate shape and whose radial overhang beyond the actuating pin can exceed the radius, preferably also the diameter, of the recess in the component to be locked.

Figure 2:
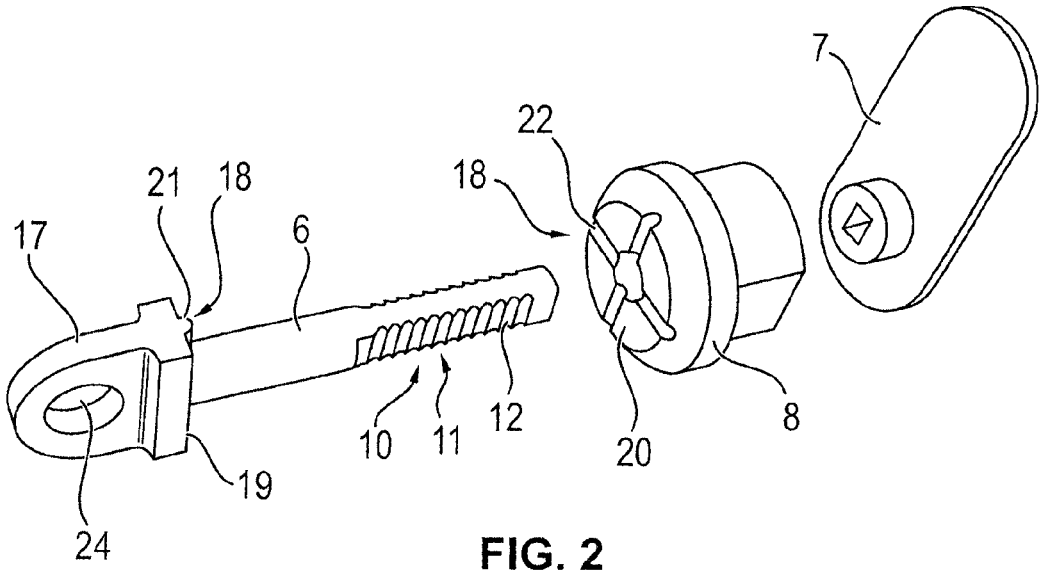
Figure 3B:
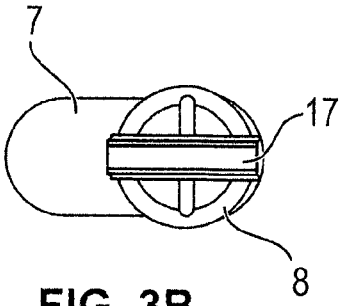
Figure 3A:
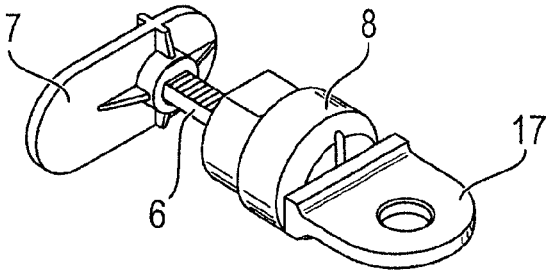
Figure 3C:
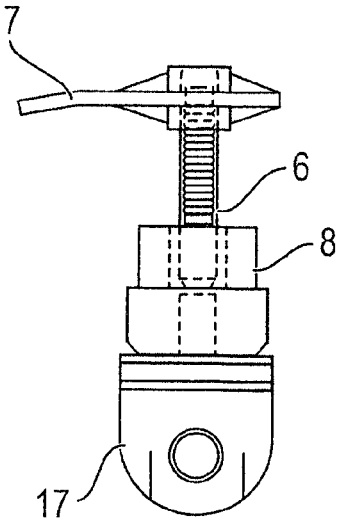
Figure 4:
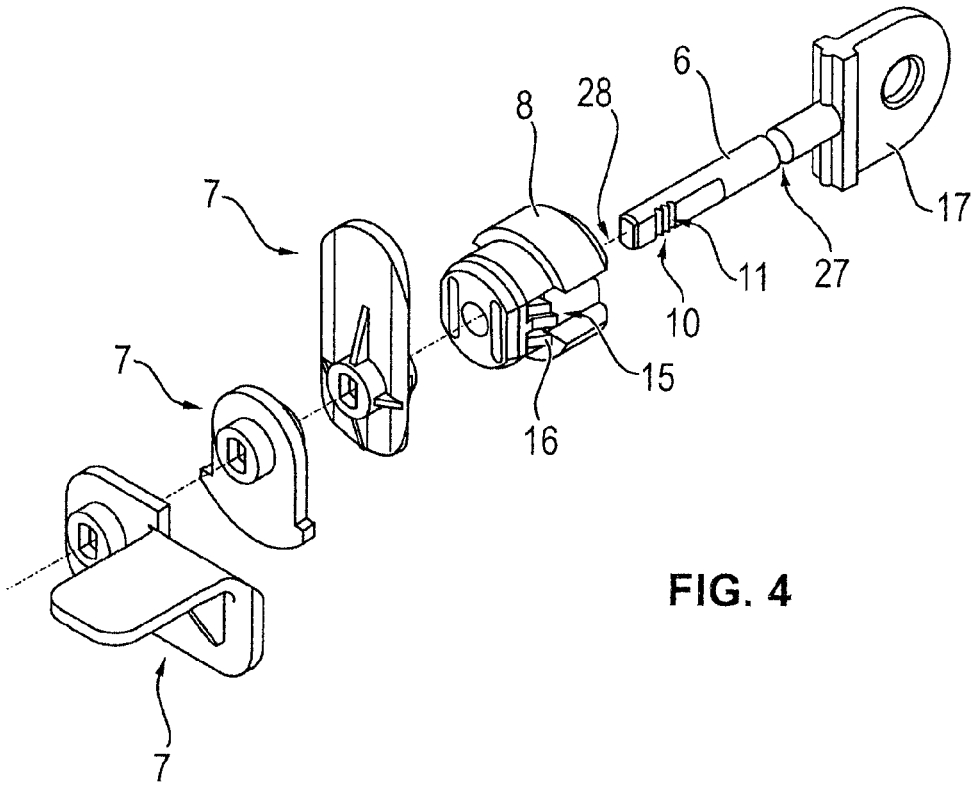
Figure 5:
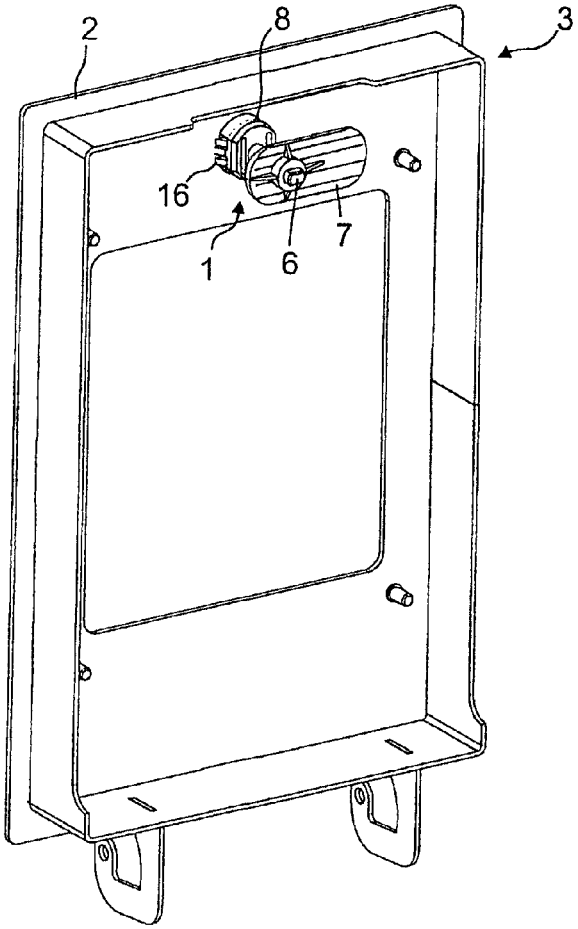
Figure 7:
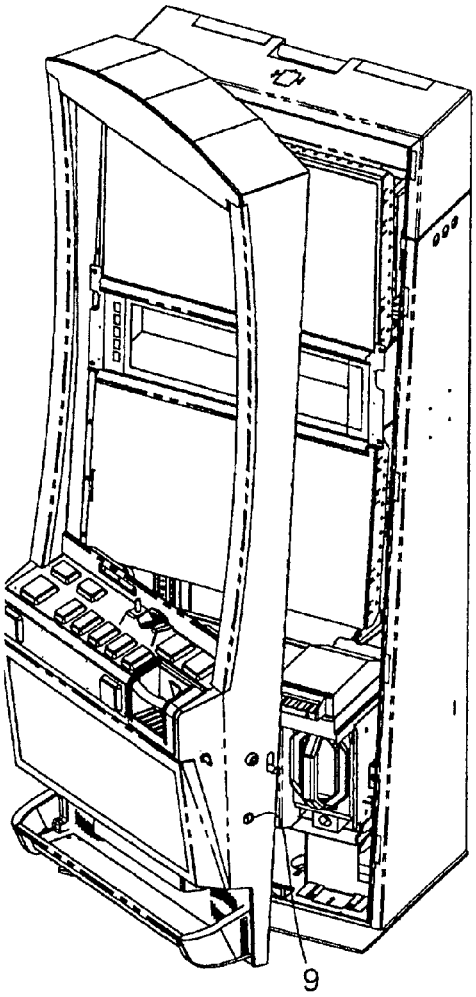
Figure 6A:
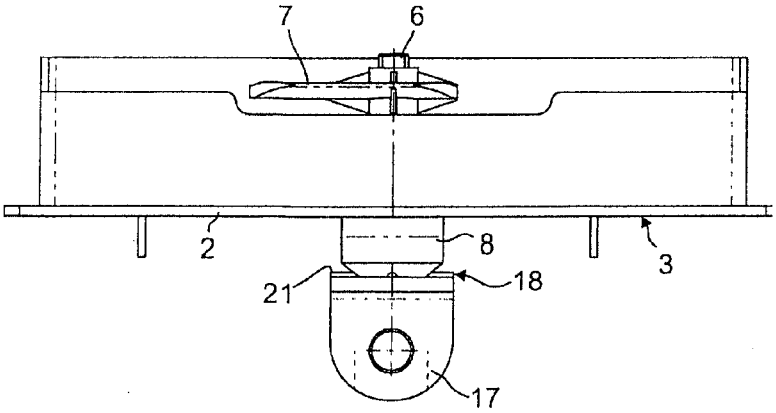
Figure 6B:
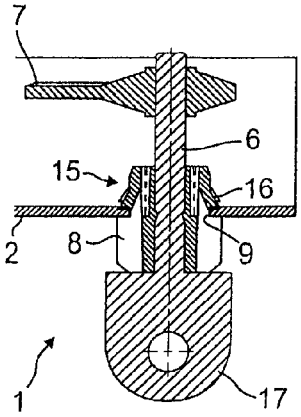

The present invention will be explained in more detail in the following with reference to a preferred embodiment and to associated drawings. There are shown in the drawings:

FIG. 1: a longitudinal section through the locking apparatus as well as a side view of the locking apparatus in accordance with an advantageous embodiment of the invention in an exploded representation which shows the actuating pin, the rotary guide part and the bolt part in a row behind one another along the rotary actuation axis of the locking apparatus;

FIG. 2: a perspective exploded representation of the locking apparatus shown in FIG. 1;

FIG. 3: different views of the locking apparatus of the two preceding Figures in the assembled state in which the actuating pin is plugged through the rotary guide part and is latched to the bolt part, wherein the part view (a) shows a perspective view, the part view (b) shows a plan view in the direction of the rotary actuation axis and the part section (c) shows a side view perpendicular to the named rotary actuation axis;

FIG. 4: a perspective exploded view of the locking apparatus of the preceding Figures, wherein different bolt parts latchable to the actuating pin are shown which are selectively latchable to the actuating pin to be able to match the locking apparatus to different devices to be locked;

FIG. 5: a perspective representation of the inner side of a device door to be locked, wherein the part of the locking apparatus, including the bolt part, the actuating pin and the rotary guide part, can be seen which projects on the inner side of the door;

FIG. 6: a side view of the locking apparatus installed in the device door from FIG. 5 in a direction of view perpendicular to the rotary actuation axis, wherein the part view in accordance with FIG. 6(*a*) shows a plan view and the part view in accordance with FIG. 6(*b*) shows a sectional view; and FIG. 7: a perspective representation of a gaming machine having a locking apparatus in accordance with the preceding Figures.

As the Figures show, the locking apparatus 1 can substantially comprise only three components, wherein a substantially mandrel-shaped actuating pin 6 can be plugged through a rotary guide part 8 so that the actuating pin 6 is rotatably received in the named rotary guide part 8 and can be rotationally connected at a pin section projecting from the rotary guide part 8 to a, for example, plate-shaped bolt part which engages behind a contour piece of a bolt striker plate to be caught or releases it in dependence on the rotational position.

The named actuating pin 6 can, as FIGS. 1 and 2 show, comprise an at least approximately cylindrical guide section 6*a* which can be adjoined by a latch section 6*b* differing from the circular. The named latch section 6*b* can—cf. FIG. 2—approximately continue the contour of the guide section 6*a*, but in this respect have at least one, preferably two, oppositely disposed flattened portions at which latching means 10 are provided for latching with the bolt part 7. The cross-sectional contour of the actuating pin 6 in the named latch section 6 is advantageously dimensioned such that it lies within the cross-sectional contour defined by the guide section 6*a* viewed in the longitudinal direction of the actuating pin 6 so that the actuating, pin 6 can be plugged without disturbance through the bearing borehole 23 in the rotary guide part 8.

At the side of the guide section 6*a* disposed opposite the named latch section 6*b*, the actuating pin 6 has an actuating head 17 which is considerably enlarged in diameter with respect to the guide section 6*a* in diameter and can in particular have the shape of an approximately plate-shaped widened portion. As FIG. 2(*a*) shows, the named actuating head 17 can comprise a passage recess 24, for example to be able to lock the actuating head 17 with a padlock or to be able to connect an actuating handle rotationally fixedly to the actuating head 17.

The end face of the actuating head 17 facing the rotary guide part 8 forms an axial bearing surface 19 which cooperates at the rotary guide part 8 with an axial bearing surface 20 which axial bearing surface 20 can be formed by an end face of the named rotary guide part 8. The named axial bearing surfaces 19 and 20 can contact one another to define the axial position of the actuating pin 6 relative to the rotary guide part 8. As FIGS. 1, 2 and also 6(*a*) show, second latching means 18 are provided at the named axial bearing surfaces 19 and 20 for rotary latching of the actuating pin 6 at the rotary guide part 8, which second latching means 18, the one hand, comprise a projecting transverse rib 21 and a plurality of transverse grooves 22 which are matched to the transverse rib 21 and which extend in different rotary orientations. In the embodiment drawn, the transverse rib 21 is provided at the actuating head 17, whereas the transverse grooves 22 are provided in the rotary guide part 8. In principle, however, the transverse rib could also conversely be provided at the rotary guide part 8 and the transverse grooves at the actuating head 17, wherein, however, in particular with the approximately plate-like contouring of the actuating pin 17 shown in the Figures, the arrangement of the transverse rib 21 at the actuating head 17 shown in the Figures is preferred to achieve a more uniform support of the axial bearing surfaces 19 and 20 on one another over the total rotary region.

For example, transverse grooves 22 which are arranged at right angles to one another can be provided at the end face of the rotary guide part 8 to be able to latch the bolt part 7 in positions rotated at right angles to one another, which rotary positions can advantageously correspond to a locked position and an unlocked position.

The latch section 6*b* of the actuating pin 6 can be introduced in accordance with its intended purpose into a counter-contour piece 13 at the bolt part 7 matched thereto, wherein the named counter-contour piece 13 and the latch section 6*b* can advantageously be configured such that they can be pushed into the named counter-contour by an axial pushing in of the actuating pin 6 in the longitudinal direction of the named actuating pin 6. The named counter-contour piece 13 can in particular be formed by a passage recess of the bolt part 7 matched in diameter to the latch section 6*b* of the actuating pin 6.

The latching means 10 for latching the bolt part 7 and the actuating pin 6 are in this respect advantageously configured such that they automatically latch on the plugging onto one another of the bolt part 7 and the actuating pin 6. The latching means 10 in this respect comprise latch contours which are provided at the bolt part 7 and at the actuating pin 6, which are each formed as undercut in the longitudinal direction of the actuating pin and which are shape-matched to one another such that an undercut pair disposed in engagement in a respective latch position can engage behind one another and overlap at least partly viewed in the longitudinal direction of the actuating pin. Latch contours, for example in the form of a latch tongue and a latch depression, can in particular be formed at the bolt part 7 and at the actuating pin 6 as latch contours and can project or be depressed transversely to the longitudinal direction of the pin, said latch tongue and latch depression being pushable beyond one another in the longitudinal direction of the pin under elastic deformation and/or deflection transversely to the longitudinal direction of the pin and thus being able to latch into one another by an elastic snapping back or springing hack transversely to the longitudinal direction of the pin and thus being able to enter into shape-matched holding engagement by which the bolt part is axially fixed at the actuating pin.

As FIG. 1 shows, the latching means 10 can, on the one hand, comprise a grooved or ribbed surface structure 11 at the actuating pin 6, in particular at the flattened portions 6*c* of the latch section 6*b* of the actuating, pin 6, the surface structure being able to comprise a plurality of holding ribs 12 which are of saw tooth shape and which are arranged staggered behind one another in the longitudinal direction of the actuating, pin 6, cf. FIG. 1. The saw tooth profile of the holding ribs 12 is in this respect advantageously orientated such that the named surface structure 11 can be pushed into the passage recess of the bolt part 7 with relatively small forces, but can only be pulled out again in the opposite direction with increased forces, or sets increased forces against a pulling out.

The counter-contour piece 13 at the bolt part 7 can likewise have a surface structure ribbed or grooved in a similar manner. As the drawn embodiment in accordance with FIG. 1 shows, the latching means 10 at the counter-contour piece 13 can, however, also have only a single holding rib 14. Depending on the design of the fit and depending on the material selection, such a holding rib could optionally be fully dispensed with, for example when the material of the counter-contour piece 13 is sufficiently soft so that the holding ribs 12 of saw tooth shape at the actuating pin 6 can dig into or hook at the named counter-contour piece 13. Conversely, it would also be conceivable to provide a corresponding, preferably saw tooth shaped and/or ribbed and/or grooved surface structure at the named counter-contour piece 13 and to configure the actuating pin 6 free of a grooved and/or ribbed surface structure, in particular when the pin is formed from a sufficiently soft and/or flowable material, for example thermoplastics, so that a surface structure at the counter-contour piece 13 can dig into or hook at the shaft of the, for example completely cylindrical latch section of the actuating pin.

However, the latch contour design shown in the Figures is preferred both at the actuating pin 6 and at the counter-contour piece 13 having mutually engaging, latch contour projections or holding ribs 12 and 14 which can be pushed beyond one another under elastic deformation and can latch into one another by an elastic springing back.

The bolt part 7 can be latched to the actuating pin 6 at different axial positions due to the holding ribs 12 staggered behind one another, i.e. the bolt part 7 be plugged more or less far, as desired in each case, onto the actuating pin 6 and can be secured in the respective position by latching the latching means 10, wherein the holding rib 14 respectively comes into shape-matched engagement with another holding rib 12.

As FIGS. 1 and 2 show, the rotary guide part 8 can comprise an at least approximately cylindrical plug-in section 25 as well as an adjoining contact or head section 26 which projects radially with respect to the plug-in section 25 and/or is configured much larger in diameter than the plug-in section 25. The named head section 26 can in particular form a contact shoulder with which the rotary guide part 8 can be set at an end-face marginal contour of the recess into which the locking apparatus 1 can be inserted. As FIGS. 5 and 6 show, a component to be locked such as the door 2 of a housing 3 of a gaming machine, but optionally also another carcass part such as a drawer, a flap or a cover, can comprise a recess 9 into which the locking apparatus 1 can be inserted. The named recess 9 can in this respect in particular be a passage recess which passes through a panel part of the device to be locked and which can, for example, be a cylindrical passage hole.

As FIG. 6(*b*) illustrates, the plug-in section 25 of the rotary guide part 8 can be shape-matched to the named recess 9 such that the plug-in section 25 can be plugged into the recess 9 with an exact fit. The outer diameter of the plug-in section 25 can in particular be adapted to the inner diameter of the recess 9 or to its clearance so that a seat with an exact fit results. In this respect, the named plug-in section 25 of the rotary guide part 8 is advantageously axially longer than the depth of the recess 9 so that the plug-in section 25 projects a little from the recess 9 on a complete plugging in, cf. FIG. 5 and FIG. 6(*b*). In its intended position, the rotary guide part 8 contacts an outer side marginal contour of the recess 9, for example a flat outer side of the component to be locked, with the shoulder of the head section 26 and projects with an end section of the plug-in section 25 on a rear side or inner side of the component from the recess.

As FIG. 4 shows, third latching means 15 are provided at the rotary guide part 8 to latch the rotary guide part 8 to the named recess 9 and to fix it in the position in accordance with its intended purpose. The named latching means 15 can in particular comprise latch projections 16 which project at the periphery of the plug-in section 25 over it radially and which can be formed, for example, by integrally molded spring tongues.

In this respect, a plurality of such latch projections 16 are advantageously arranged staggered behind one another in an axial plug-in direction to be able to latch the rotary guide part 8 with an exact fit to carcass parts of different thickness or to recesses 9 of different depths. The named latch projections 16 are spaced apart from the shoulder of the head section 26 of the rotary guide part by different amounts for this purpose so that the different latch projections 16 define a different clearance from the named head section 26. Depending on how thick the marginal contour surrounding the recess 9 is, a different latch projection 16 latches, as is shown in FIG. 6(*b*).

The named latch projections 16 are advantageously arranged group-wise distributed over the periphery of the rotary guide part 8, for example pair-wise on oppositely disposed sides so that at least two latch projections spaced apart from the shoulder of the head section 26 by the same amounts can always latch.

FIG. 4 furthermore shows different bolt parts 7 which can be latched with the actuating pin 6 and which can be selectively latched to the actuating pin 6 to be able to match the locking apparatus 1 to different devices to be locked. In a further embodiment (not shown in the Figures), a bolt part 7 can have a hook-shaped section which can be brought into engagement with a corresponding counter-piece in a locked position.

As can be seen, from example, from FIGS. 4, 5 and 6, the locking apparatus 1 can be assembled as follows: First, the rotary guide part 8 is pushed from the outside into the recess 9 at the device 3 to be locked, for example the door 2 shown, so that the latch projections 16 latch and the rotary guide part 8 is held at the door 2 at an exact position.

The actuating pin 6 is then plugged into the rotary part 8. Optionally, the plugging-in of the actuating pin 6 can also already take place before the insertion of the rotary guide part 8. As FIG. 6(*b*) shows, latching means 27 can latch or hold the actuating pin 6 axially in the rotary guide part 8. Said latching means 27 can, for example, comprise an annular projection in the passage bore 23 of the rotary guide part 8 and an annular constriction at the actuating pin 6 which snap into the rotary guide part 8 on reaching the axial position of the actuating pin 6 according to its intended purpose to hold the actuating pin 6 axially fixedly, but rotatably about the axis of rotation 28 of the actuating pin 6. Alternatively, an annular latch projection which can latch into an annular groove or into another latch contour at the rotary guide part 8 could also be provided at the actuating pin 6.

The bolt part 7 is then axially plugged onto the actuating pin 6 from the oppositely disposed side of the component to be locked, that is in particular from its inner side, and is pushed so far onto the pin until the bolt part 7 has reached the desired axial position which can be seen from FIG. 6(*a*). In this respect, the latching means 10 move into latching engagement and fix the bolt part 7 axially on the actuating pin 6.

The bolt part 7 is simultaneously rotationally fixedly connected to the actuating pin 6 by the contour shape of the latch section 6*b* differing from the circular and by a contour shape of the counter-contour piece 13 likewise different from the circular so that the bolt part 7 can be moved to and fro between a locking and a non-locking position by rotating the actuating pin 6. In this respect, the transverse rib 21 at the actuating head 17 and one of the transverse grooves 22 at the rotary guide part 8 respectively come into engagement to hold the actuating pin 6 and thus the bolt part 7 in a latching manner in the locked position and in the non-locked position.

To dismantle the locking apparatus 1, a procedure can generally be followed in the opposite order as in the assembly in order then, for example, to install the desired final lock into the recess 9 by the end customer.

The gaming device shown in FIG. 7 in the drawn embodiment is configured as a so called upright device which comprises a closet-like device housing in which a display unit is provided in the form of two large screens and a display field disposed therebetween for displaying gaming, information in a manner known per se. A projecting operating panel section which can comprise operating buttons for the game control is provided at the front side at the device housing in a lower half. Furthermore a mouthpiece for introducing bills into a bill processing device is provided at the front side of the device housing, for instance in the region of the named operating panel section. In the embodiment shown, a housing door is pivotally connected to the base housing carcass pivotable about an upright axis. The housing door has a recess 9 into which the locking apparatus 1 can be inserted.

The invention claimed is:

1. A locking apparatus for introduction into a recess of a device to be locked, the locking apparatus comprising:

an actuating pin; and a bolt part rotatably fixedly connectable to the actuating pin, wherein the bolt part is configured to be locked or unlocked by rotating the actuating pin, wherein the bolt part is configured to be fastened in a plurality of positions such that the actuating pin and the bolt part have releasable latching means having a plurality of latching positions for latching the bolt part in a plurality of axial positions at the actuating pin, wherein the latching means have latch contours, wherein the latch contours are configured to engage into one another in a shape-matched manner, wherein the latch contours are configured to be pushed beyond one another in the longitudinal direction of the actuating pin under elastic deformation, and wherein the latch contours are configured to latch into one another by elastically springing back transversely to the longitudinal direction of the actuating pin, wherein the latch contours comprise a ribbed or grooved surface structure at the actuating pin and at the bolt part, wherein the surface structure is configured to be brought into shape-matched holding engagement with a counter-contour piece under elastic deformation of at least one of the surface structure and the counter-contour piece when the bolt part and the actuating pin axially plug onto one another, wherein the ribbed surface structure comprises a plurality of holding ribs at the actuating pin, wherein the plurality of holding ribs are arranged staggered behind one another in the longitudinal direction of the actuating pin at least partly at the periphery of the actuating pin, and wherein the counter-contour piece comprises at least one counter-contour holding rib at the bolt part.

2. The locking apparatus of claim 1, wherein the latch contours of the latching means comprise at least one latch projection configured to be elevated transversely to the longitudinal direction of the actuating pin and at least one latch depression sunk transversely to the longitudinal direction of the actuating pin, wherein the latch depression and the latch projection are configured to shape-match to one another, wherein the latch projection is lowered into the latch depression, and wherein the latch contours of the latching means are configured as undercuts in the longitudinal direction of the actuating pin.

3. The locking apparatus of claim 1, wherein the at least one counter-contour holding rib of the counter-contour piece is provided at least partly at an inner peripheral side of the bolt part or in a passage recess of the bolt part, and wherein the at least one counter-contour holding rib is plugged onto the actuating pin.

4. The locking apparatus of claim 1, wherein the plurality of holding ribs and the at least one counter-contour holding rib are configured in the form of saw teeth, and wherein the surface structure has a contour such that plug-on forces which are necessary for the axial plugging on of the bolt part and the actuating pin are smaller than removal forces which are necessary for the axial pulling of the bolt part from the actuating pin and for the release of the latch connection.

5. The locking apparatus of claim 1, wherein the actuating pin comprises a rotary guide part, wherein the rotary guide part is configured to plug into the recess with an exact fit, and wherein the rotary guide part has rotary guide latching means configured to latch to a marginal contour surrounding the recess.

6. The locking apparatus of claim 5, wherein a plurality of rotary latch projections are provided at the rotary guide part, wherein the plurality of rotary latch projections are arranged staggered behind one another in the longitudinal direction of the rotary guide part such that the plurality of rotary latch projections are configured to be latched with an exact fit with marginal contours of the recess of different thicknesses.

7. The locking apparatus of claim 5, wherein the actuating pin is configured to be rotatably received in the rotary guide part, and wherein the rotary guide part is configured to be rotationally fixedly latchable in the recess.

8. The locking apparatus of claim 5, wherein the actuating pin and the rotary guide part have two releasable latching means, and wherein the two releasable latching means are configured for the releasable rotary latching of the actuating pin in an unlocked rotary position or in a locked rotary position.

9. The locking apparatus of claim 1, wherein the actuating pin comprises an actuating head, wherein the actuating head is configured to be plugged from one side into the recess such that the actuating head comes to lie on a side of the recess, and wherein the bolt part is set onto the actuating pin from an oppositely disposed side of the recess.

10. The locking apparatus of claim 1, wherein the actuating pin has a circular-cylindrical rotary guide section and a latch section, wherein the latch section has a cross-sectional contour different from the circular-cylindrical rotary guide section, and wherein the latch section lies within the contour of the circular-cylindrical rotary guide section viewed in the longitudinal direction of the pin.

11. The locking apparatus of claim 10, wherein the-latch section of the actuating pin comprises oppositely disposed flattened portions at which the latch means are provided.

12. The locking apparatus of claim 1, wherein the locking apparatus is configured to be used as a provisional transport security of a lockable carcass part of a gaming or entertainment device, wherein the transport security is replaced by a final closing system.

13. A locking apparatus for introduction into a recess of a device to be locked, the locking apparatus comprising:

an actuating pin; and a bolt part rotatably fixedly connectable to the actuating pin, wherein the bolt part is configured to be locked or unlocked by rotating the actuating pin, wherein the bolt part is configured to be fastened in a plurality of positions, such that the actuating pin and the bolt part have releasable latching means having a plurality of latching positions for latching the bolt part in a plurality of axial positions at the actuating pin, wherein the latching means have latch contours, wherein the latch contours are configured to engage into one another in a shape-matched manner, wherein the latch contours are configured to be pushed beyond one another in the longitudinal direction of the actuating pin under elastic deformation, and wherein the latch contours are configured to latch into one another by elastically springing back transversely to the longitudinal direction of the actuating pin, wherein the actuating pin comprises a rotary guide part, wherein the rotary guide part is configured to plug into the recess with an exact fit, and wherein the rotary guide part has rotary guide latching means configured to latch to a marginal contour surrounding the recess, wherein the rotary guide latching means of the rotary guide part comprise at least one rotary latch projection projecting radially at the peripheral side from the carcass of the rotary guide part, wherein the at least one rotary latch projection is configured to be radially elastically deformable during the axial plugging of the rotary guide part into the recess, and wherein the at least one rotary latch projection is configured to snap back radially after passing through the recess.

14. The locking apparatus of claim 13, wherein the latch contours of the latching means comprise at least one latch projection configured to be elevated transversely to the longitudinal direction of the actuating pin and at least one latch depression sunk transversely to the longitudinal direction of the actuating pin, wherein the latch depression and the latch projection are configured to shape-match to one another, wherein the latch projection is lowered into the latch depression, and wherein the latch contours of the latching means are configured as undercuts in the longitudinal direction of the actuating pin.

15. The locking apparatus of claim 13, wherein the latch contours comprise a ribbed or grooved surface structure at the actuating pin and at the bolt part, wherein the surface structure is configured to be brought into shape-matched holding engagement with a counter-contour piece under elastic deformation of at least one of the surface structure and the counter-contour piece when the bolt part and the actuating pin axially plug onto one another.

16. A locking apparatus for introduction into a recess of a device to be locked, the locking apparatus comprising:

an actuating pin; and a bolt part rotatable fixedly connectable to the actuating pin, wherein the bolt part is configured to be locked or unlocked by rotating the actuating pin, wherein the bolt part is configured to be fastened in a plurality of positions, such that the actuating pin and the bolt part have releasable latching means having a plurality of latching positions for latching the bolt part in a plurality of axial positions at the actuating pin, wherein the latching means have latch contours, wherein the latch contours are configured to engage into one another in a shape-matched manner, wherein the latch contours are configured to be pushed beyond one another in the longitudinal direction of the actuating pin under elastic deformation, and wherein the latch contours are configured to latch into one another by elastically springing back transversely to the longitudinal direction of the actuating pin, wherein the actuating pin comprises a rotary guide part, wherein the rotary guide part is configured to plug into the recess with an exact fit, and wherein the rotary guide part has rotary guide latching means configured to latch to a marginal contour surrounding the recess, wherein the actuating pin or the rotary guide part have axial latching means for axial latching, wherein the axial latching means is configured to allow axial rotary movements of the actuating pin at the rotary guide part, and wherein the axial latching means are configured such that the actuating pin is movable elastically a little axially from the axial position latched and is urged back elastically by the axially latching means into the axial position latched.

17. The locking apparatus of claim 16, wherein the latch contours of the latching means comprise at least one latch projection configured to be elevated transversely to the longitudinal direction of the actuating pin and at least one latch depression sunk transversely to the longitudinal direction of the actuating pin, wherein the latch depression and the latch projection are configured to shape-match to one another, wherein the latch projection is lowered into the latch depression, and wherein the latch contours of the latching means are configured as undercuts in the longitudinal direction of the actuating pin.

18. The locking apparatus of claim 16, wherein the latch contours comprise a ribbed or grooved surface structure at the actuating pin and at the bolt part, wherein the surface structure is configured to be brought into shape-matched holding engagement with a counter-contour piece under elastic deformation of at least one of the surface structure and the counter-contour piece when the bolt part and the actuating pin axially plug onto one another.

19. A locking apparatus for introduction into a recess of a device to be locked, the locking apparatus comprising:

an actuating pin; and a bolt part rotatably fixedly connectable to the actuating pin, wherein the bolt part is configured to be locked or unlocked by rotating the actuating pin, wherein the bolt part is configured to be fastened in a plurality of positions, such that the actuating pin and the bolt part have releasable latching means having a plurality of latching positions for latching the bolt part in a plurality of axial positions at the actuating pin, wherein the latching means have latch contours, wherein the latch contours are configured to engage into one another in a shape-matched manner, wherein the latch contours are configured to be pushed beyond one another in the longitudinal direction of the actuating pin under elastic deformation, and wherein the latch contours are configured to latch into one another by elastically springing back transversely to the longitudinal direction of the actuating pin, wherein the actuating pin comprises a rotary guide part, wherein the rotary guide part is configured to plug into the recess with an exact fit, and wherein the rotary guide part has rotary guide latching means configured to latch to a marginal contour surrounding the recess, wherein the actuating pin and the rotary guide part have two releasable latching means, and wherein the two releasable latching means are configured for the releasable rotary latching of the actuating pin in an unlocked rotary position or in a locked rotary position, wherein the two releasable latching means are provided at an axial support surface of the rotary guide part and of the actuating pin, and wherein the two releasable latching means comprise at least one transverse rib extending transversely to the axis of rotation of the actuating pin or one transverse groove extending transversely to the axis of rotation of the actuating pin.

20. The locking apparatus of claim 19, wherein the latch contours of the latching means comprise at least one latch projection configured to be elevated transversely to the longitudinal direction of the actuating pin and at least one latch depression sunk transversely to the longitudinal direction of the actuating pin, wherein the latch depression and the latch projection are configured to shape-match to one another, wherein the latch projection is lowered into the latch depression, and wherein the latch contours of the latching means are configured as undercuts in the longitudinal direction of the actuating pin.

* * * * *